United States Patent [19]

Halopoff

[11] 4,238,941

[45] Dec. 16, 1980

[54] SECURITY SHIELD FOR PADLOCK

[76] Inventor: David Halopoff, 7460 Bandini Blvd., Los Angeles, Calif. 90040

[21] Appl. No.: 941,296

[22] Filed: Sep. 11, 1978

[51] Int. Cl.[3] ..... E05B 67/38

[52] U.S. Cl. ..... 70/56; 70/417

[58] Field of Search ..... 70/52, 53, 54, 55, 56, 70/417

[56] References Cited

U.S. PATENT DOCUMENTS

| | | | |
|---|---|---|---|
| 3,751,948 | 8/1973 | Klein | 70/55 |
| 3,783,657 | 1/1974 | Foote | 70/52 |

*Primary Examiner*—Robert L. Wolfe

[57] ABSTRACT

A security shield for protection of the shackle of a padlock makes use of a sheet of metal of relatively heavy gage which has one portion bent to a position where it overlies one side of the shackle when the shackle is in locked position on the body of the padlock making it difficult for an unauthorized person with an appropriate rod cutter or chisel to cut through the shackle and release the padlock. The shield is attached to the padlock itself, either permanently or temporarily, by use of a second portion of the sheet of metal bent to a suitable position where it is attached to and carried by the body of the padlock.

9 Claims, 7 Drawing Figures

SECURITY SHIELD FOR PADLOCK

For such places, for example, as garages and mini-storage facilities padlocks are commonly used for securing the doors, especially for securing large overhead type doors. A variety of types of hasps are available for mounting on the door or door frame and one frequently made use of features a sliding latch bolt capable of being locked by insertion of the shackle of a padlock through a hole in a bracket over which a loop of the latchbolt has been applied. For other types of hardware the shackle may be used to interconnect a pair of adjacent rings, or perhaps a ring projected through a slot in a latch plate.

Irrespective of the type of hasps which may be employed the shackle of the padlock is usually exposed where an unauthorized person with, for example, a cable cutter, or other appropriate tool, can cut through the shackle and release the lock. On other occasions a padlock may be sprung by a sharp heavy blow against the body frequently in a direction away from the shackle.

In an effort to minimize the opportunity to forcibly open a padlock by one or another of the ways made reference to various shields have been employed. For the most part such shields have been built into the hasp, and on some occasions have actually been mounted on the latchbolt itself so as to always be in a position protecting the latch bolt against forceable release.

It is among the objects of the present invention to provide a new and improved security shield for the shackle of a padlock which is mounted on the padlock itself rather than on the hardware to which the padlock may be attached.

Another object is to provide a new and improve security shield for a padlock which has a permanent attachment to the padlock so that it can not be readily removed and misplaced.

Still another object of the invention is to provide a new and improved security shield for a padlock of such character that it can be applied to the body and shackle of a conventional padlock when the shackle is unlocked but which becomes anchored in place when the shackle is locked, thereby to place a protecting shield in a guarding position adjacent to the shackle and substantially minimize the prospect of unauthorized tampering and vandalism with respect to the padlock.

Still further among the objects of the invention is to provide a new and improved security shield for a padlock carried by the padlock itself independent of the door hardware with which it may be used, and which is anchored sufficiently close to the shackle so as to greatly inhibit forceable release of the padlock as by cutting the shackle.

Included further among the objects of the invention is to provide a new and improved padlock security shield of simple rugged construction which is automatically positioned in the most effective protecting location for the padlock when the padlock is locked, and irrespective of the hardware which may be chosen for securing a door in closed position.

With these and other objects in view, the invention consists in the construction, arrangement, and combination of the various parts of the device, taken as examples of acceptable forms of the invention, though not expressly limited to the forms shown, whereby the objects contemplated are attained, as hereinafter set forth, illustrated in the accompanying drawings and pointed out in the appended claims.

Figure 2:
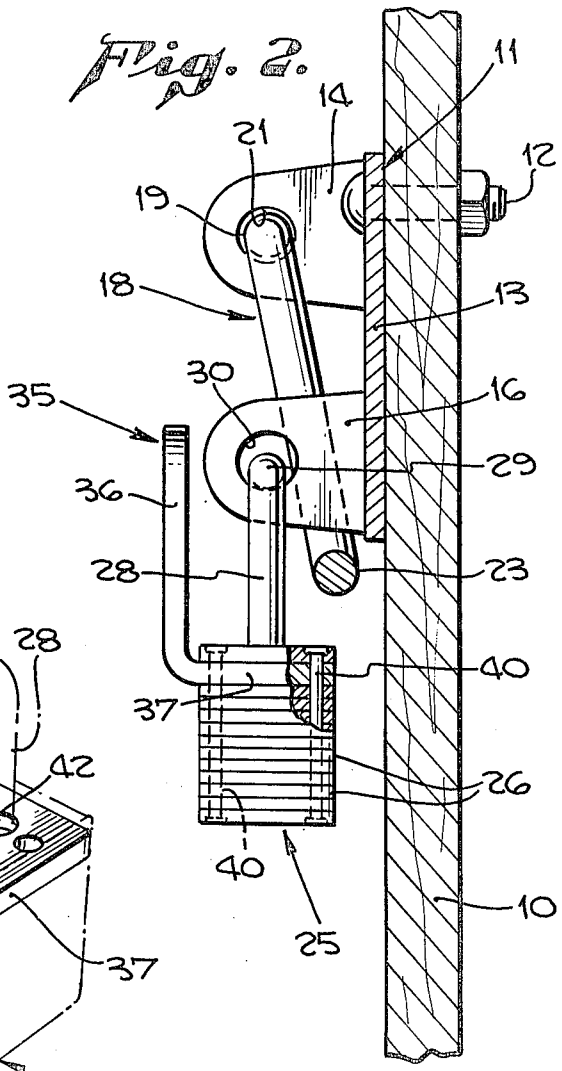
FIG. 2 is a longitudinal sectional view on the line 2—2 of FIG. 1.

In an embodiment of the invention in one of several forms chosen for the purpose of illustration there is shown a conventional door 10 provided with a conventional hasp 11 mounted on the door 10 by use of bolts 12. The hasp 11 consists of a backplate 13, a pair of brackets 14 and 15 in transverse alignment and a second pair of brackets 16 and 17, likewise in transverse alignment.

Figure 1:
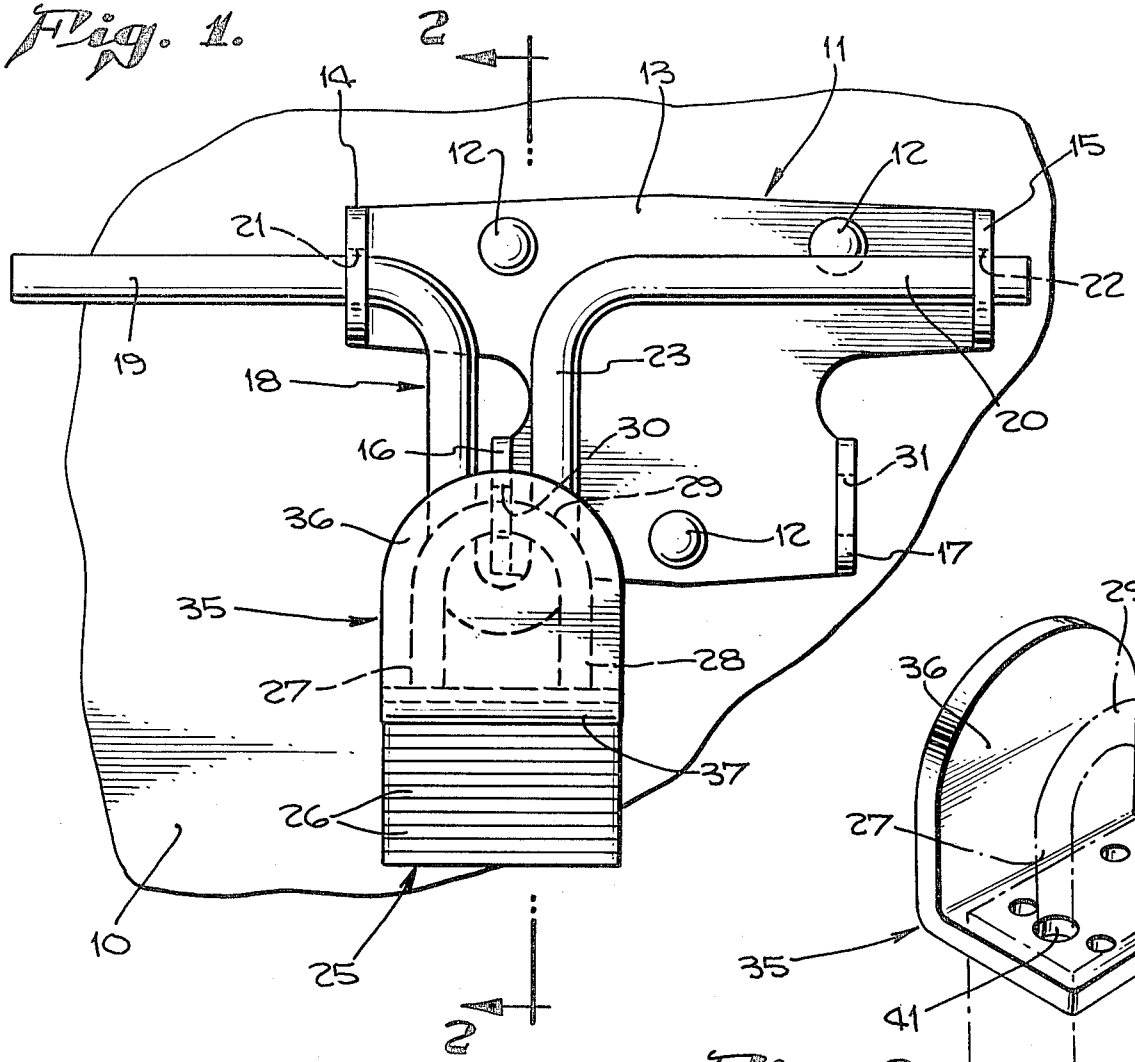
FIG. 1 is a side elevational view of one form of the invention applied to a laminated padlock and with the padlock locked in position on a hasp for a garage type door.

A latch bolt 18 has axially aligned legs 19 and 20 with the leg 19 extending through a hole 21 in the bracket 14 and leg 20 extending through a hole 22 in the bracket 15. Parts of the legs 19 and 20 extend in the form of a loop 23 with opposite sides spaced from each other and adapted to overlie either the bracket 16, as in FIG. 1, or the bracket 17.

In the first described embodiment of the invention use is made of a conventional padlock having a body 25 composed of laminations 26 and a shackle with a captive leg 27, a free leg 28 and an end portion 29 interconnecting outer ends of said legs. The shackle is adapted to engage either a hole 30 of the bracket 16 or a hole 31 of the bracket 17.

A security shield 35 for this form of the invention is made of relatively heavy gage sheet metal with a guard section 36 and an anchor section 37 in an angular relationship. The guard section is sufficiently large so that it overlies the end portion 29 and both legs 27 and 28 of the shackle, on one side of the shackle and spaced a slight distance from it.

The anchor section 37 of the security shield is slightly larger than the laminations 26 of the padlock body and lies intermediate end laminations of the body where it is secured by conventional rivets 40. A hole 41 accomodates one leg 27 of the shackle and a hole 42 accomodates the other leg 28 with a free sliding fit. When the security shield is in position with the shackle locked the guard section of the shield is spaced close to the shackle and in a position such that it is difficult for an unauthorized person either to cut the shackle with a rod cutter, or to effectively strike the padlock body with an appropriate instrument to jar the shackle loose, whereby to force the padlock open.

Figure 4:
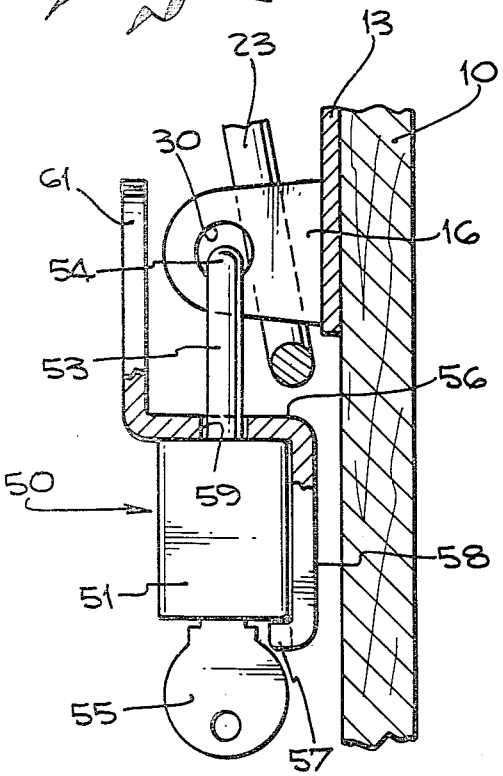
FIG. 4 is a side elevational view, partially in section, showing a second form of the invention applied to a conventional padlock body, in position on a hasp.
Figure 5:
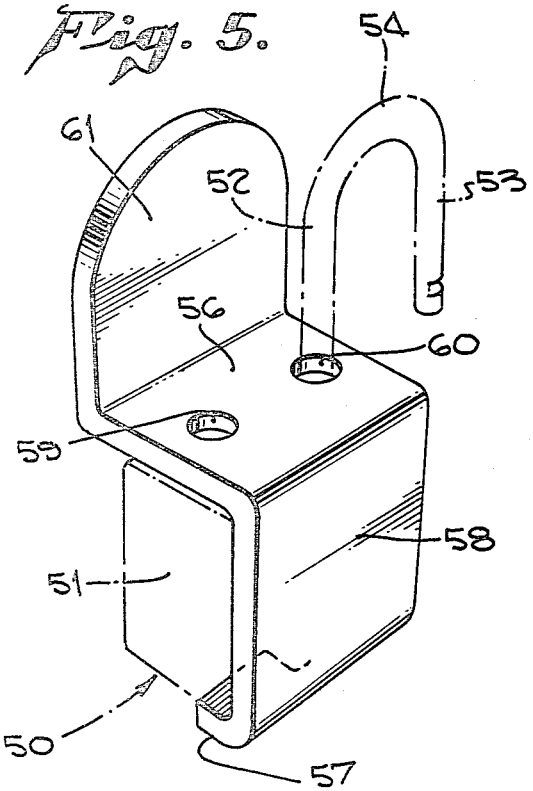
FIG. 5 is a side perspective view of the security shield of FIG. 4 with the hasp in open position.

In the second form of the invention of FIGS. 4 and 5 a padlock 50 has been pictured having a body 51 devoid of laminations. The shackle comprises legs 52 and 53 joined by an outer end 54. In this form one leg 52 is shown as a pivoting captive leg. Clearly a padlock having both legs adapted to be freed can also be accomodated by the various security shields. An appropriate conventional key hole (not shown) is adapted to be provided at the end of the body 51 remote from the shackle for manipulation by a conventional key 55.

Figure 3:
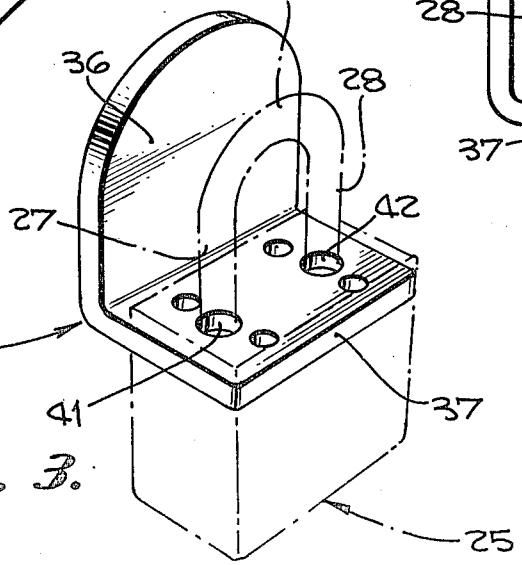
FIG. 3 is a side perspective view of a padlock provided with a security shield of FIG. 1.

In this form of the invention the anchor section is a composite section having a first portion 56 adapted to overlie the shackle end of the padlock 51, a second portion 57 adapted to overlie the opposite end and a third portion 58 interconnecting the first and second portions. To accomodate the legs 52 and 53 of the shackle there are provided respective apertures 59 and 60. A guard section 61 is similar to the guard section 36 of FIGS. 1, 2 and 3 and performs in a comparable manner.

To apply the security shield 50 to a padlock the shackle is first unlocked and swung to a laterally open position as shown by the broken lines of FIG. 50. The leg 53 is then inserted into the underside of the aperture 60, there being adequate clearance, and the shield 50 then swung over the shackle to the position of FIG. 5. Once the shackle is fastened in locked position as in FIG. 4, the security shield is held in place by action of the shackle and cannot be removed except by first unlocking the padlock. The second portion 57 being narrow allows room for the key 55 to be operated.

Figure 6:
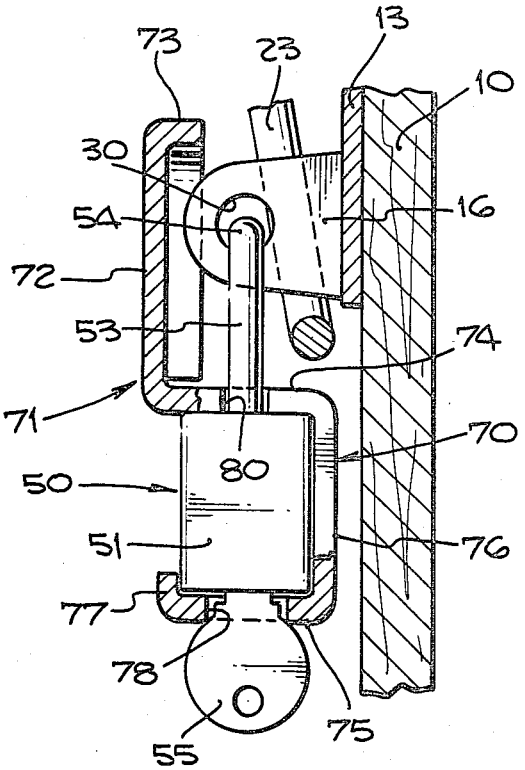
FIG. 6 is a side elevational view partially in section showing a third form of the invention applied to a conventional padlock body.
Figure 7:
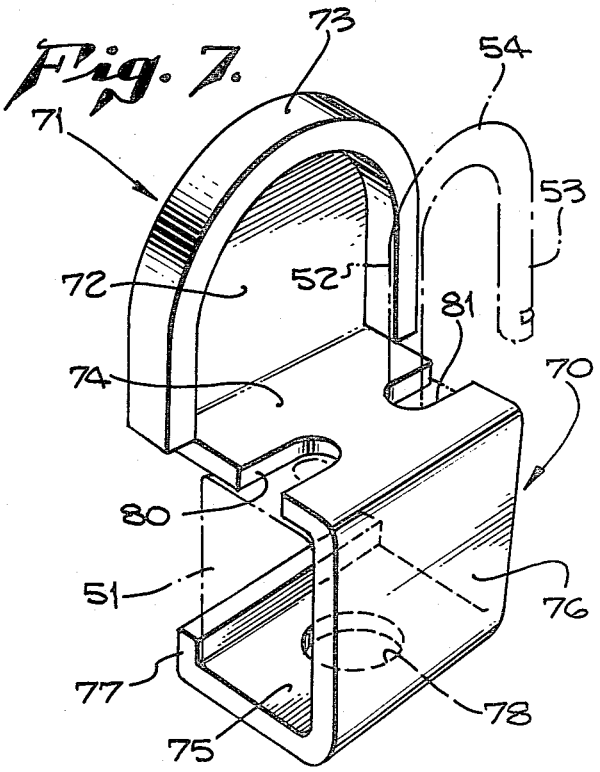
FIG. 7 is a side perspective view of the security shield of FIG. 6 with the hasp in open position.

For the form of invention of FIGS. 6 and 7 a slightly different structure is embodied in an anchor section 70 of a security shield 71. Guard section 72 remains generally the same, except for being provided with a protective flange 73. Of the anchor section 70, a first portion 74 overlies the shackle end of the padlock, a second portion 75 overlies the opposite end and a third portion 76 interconnects the first and second portions 74 and 75. In this form there is an additional lip 77 which overlies the side of the padlock body 51. A hole 78 is made in the portion 75 for accomodation of a conventional key hole (not shown) and key 78.

To make possible attachment of the form of invention of FIGS. 6 and 7 to a padlock having a body 51 and shackle similar to that of FIGS. 4 and 5 a somewhat modified aperture is needed, for manipulation of the shield into position. For Example, the aperture 80 is in the form of a side open slot, as is also the aperture 81. The aperture 81, for example, corresponding to the pivotally mounted leg 52, is applied over the leg 52 when the shackle is in unlocked open position as shown by the broken lines of FIG. 7. When the padlock with the security shield 71 is then attached to the hasp and the leg 53 pushed into locked position, the leg extends through the aperture 80 and fastens the security shield in place on the padlock.

Having described the invention, what is disclosed as new in support of Letters Patent is as follows:

What is claimed is:

1. A security shield for protection of a padlock of the type which has a body and a shackle, the shackle having legs and an end portion joining the legs arranged so that the legs have an open position and a locked position, said shield comprising a guard section and an anchor section, said guard section having a guarding position spaced laterially at a substantial distance from said legs and said end portion and overlying the shackle at one side only of said shackle when the shackle is in locked position, said anchor section having a mounting on the body, both sections having positions relative to each other providing a clear space enabling the shackle to move clear of the body to open position.

2. A security shield as in claim 1 wherein the guard section is a plate which overlies only one side of the outer end and both legs of the shackle and the anchor section is a plate in engagement with the body.

3. A security shield as in claim 1 wherein the anchor section is anchored to the body at a location spanning the location of the shackle on the body when the shackle is in locked position and providing holes for reception of the shackle.

4. A security shield as in claim 1 wherein the guard section and the anchor section are plates in an angular relationship to each other, the anchor section being anchored on the body at the end adjacent the shackle leaving the body exposed and the guard section being spaced laterally from the shackle.

5. A security shield for protection of a padlock of the type which has a body and a shackle, the shackle having legs and an end portion joining the legs arranged so that the legs have an open position and a locked position, said shield comprising a guard section and an anchor section, said guard section having a guarding position overlying the shackle at one side thereof when the shackle is in locked position, said anchor section having a mounting on the body, both sections having positions relative to each other providing a clear space enabling the shackle to move clear of the body to open position, the body of the padlock comprising a plurality of laminations and the anchor section being anchored between adjacent laminations.

6. A security shield for protection of a padlock of the type which has a body and a shackle, the shackle having legs and an end portion joining the legs arranged so that the legs have an open position and a locked position, said shield comprising a guard section and an anchor section, said guard section having a guarding position overlying the shackle at one side thereof when the shackle is in locked position, said anchor section having a mounting on the body, both sections having positions relative to each other providing a clear space enabling the shackle to move clear of the body to open position, the anchor section being a composit section with a first portion having aperture means for reception of the legs of the shackle, a second portion underlying the body of the padlock on the side opposite said legs and a third portion interconnecting said first and second portions.

7. A security shield as in claim 6 wherein the padlock body has a key hole and there is an opening in one of said portions at a location coinciding with said key hole.

8. A security shield as in claim 6 wherein the aperture means in the first portion are entirely surrounded by material of said first portion.

9. A security shield as in claim 6 wherein the aperture means in said first portion are open at opposite sides whereby to enable said anchor section to be attached in position around the shackle when the shackle is in open position.

* * * * *